United States Patent [19]

Simpson et al.

[11] 4,296,582

[45] Oct. 27, 1981

[54] CONSTRUCTION SYSTEM AND FASTENERS THEREFORE

[75] Inventors: Harold G. Simpson; Michael W. Davis, both of Oklahoma City, Okla.

[73] Assignee: Star Manufacturing Company of Oklahoma, Oklahoma City, Okla.

[21] Appl. No.: 645,566

[22] Filed: Dec. 31, 1975

[51] Int. Cl.[3] ..... E04C 1/10

[52] U.S. Cl. ..... 52/590; 52/747

[58] Field of Search ..... 52/384, 590, 592, 127, 52/747, 105, 468, 471, 127, 290; 242/68.5; 204/159.14; 24/201 C, 205.13

[56] References Cited

U.S. PATENT DOCUMENTS

| | | | |
|---|---|---|---|
| 2,495,033 | 1/1950 | Sullivan | 24/205.13 |
| 2,613,421 | 10/1952 | Madsen | 150/3 |
| 2,665,467 | 1/1954 | Bosomworth et al. | 24/201 C |
| 2,791,807 | 5/1957 | Morin | 150/3 |
| 2,955,953 | 10/1960 | Graham | 204/159.14 |
| 3,038,205 | 6/1962 | Plummer | 24/201 C |
| 3,070,864 | 1/1963 | Pfeffer | 24/201 C |
| 3,084,114 | 4/1963 | Gilbert et al. | 204/159.14 |
| 3,135,647 | 1/1964 | Wheeley | 52/127 |
| 3,292,323 | 12/1966 | Hagan | 52/127 |
| 3,320,706 | 5/1967 | Elliott et al. | 52/471 |
| 3,381,436 | 5/1968 | Elliott et al. | 52/471 |
| 3,408,250 | 10/1968 | Finefrock | 52/290 |
| 3,426,892 | 2/1969 | Poncy | 242/68.5 |
| 3,694,983 | 10/1972 | Couquet | 52/384 |
| 3,918,233 | 11/1975 | Simpson | 52/747 |
| 3,935,682 | 2/1976 | Simpson | 52/105 |

OTHER PUBLICATIONS

A. Renfrew & Phillip Morgan, Polythene, The Technology and Uses of Ethylene Polymers, London: Iliffe & Sons Ltd., 1963, pp. 326–329, 397–405.

*Primary Examiner*—James L. Ridgill, Jr.

*Attorney, Agent, or Firm*—Hubbard, Thurman, Turner, Tucker & Glaser

[57] ABSTRACT

A construction system is disclosed utilizing prefabricated panels which can be assembled in a contiguous, aligned relationship to form a construction section. In one form of the system, the individual panels may include a structural core with a flexible membrane covering, and include an edge portion adapted to engage the edge portion of the next adjacent panel to provide a substantially continuous seal between panels. The edge portions are sealable by fasteners which may be in the form of interlocking male and female members proportioned so that when joined the male members of one fastener will wipe along the inside walls of the fastener to which it is being connected to clean dirt from these walls and push the dirt into one or more dirt cavities formed when the fasteners are joined. Multiple areas of intense contact are also provided between the mating members of the fasteners to provide an effective watertight seal. The fasteners may be pre-shaped during manufacture to increase the pressure along the areas of intense contact after joining.

Also, a distinctive indicator, such as a color stripe along one or more of the ribs of each of the fasteners, may be provided which is visible during installation of the system when adjacent interlocking fasteners have not been fully engaged, and substantially hidden when the fasteners are so engaged by the coacting flaps on the fasteners.

A complete system and apparatus used therein, and a method of utilizing said apparatus, is also disclosed for manufacturing the fasteners, pre-shaping them, and bonding them to the flexible membrane panels in accordance with this invention.

19 Claims, 37 Drawing Figures

CONSTRUCTION SYSTEM AND FASTENERS THEREFORE

BACKGROUND AND SUMMARY OF THE INVENTION

This invention relates to a construction system utilizing prefabricated panels adapted to form a roof, wall, flashing, accessory, tank, container, pool, pond liner, or other construction sections, and in one of its aspects to interlocking, self-cleaning fasteners for use in providing a substantially continuous seal between the panels.

The construction of roofs, walls and other elements by conventional methods is a laborious process usually requiring on-site fabrication and erection of a suitable support structure. In an attempt to improve on conventional construction methods, it has been suggested to utilize panels which are prefabricated at the factory and are secured together at the job site. Co-pending patent applications Ser. No. 336,370, entitled "Roof Construction," and Ser. No. 336,364, entitled "Construction System," both filed on Feb. 27, 1973, and assigned to the assignee of this invention, illustrate highly satisfactory apparatus and methods for providing such improvements.

In patent application Ser. No. 336,364, a composite panel is disclosed as having a structural core which may be conventional laminated foam, cellular honeycomb or concrete, as well as other construction materials. An exterior sheeting or membrane of weathertight material such as a plastic or light gauge metal is secured to the outer surface of the panel. The membrane is formed with a flap along one or several edges which is adapted to overlie a marginal portion of an adjacent panel. The membrane flap is adapted to sealingly engage the marginal portion of the next adjacent panel. In the preferred form of the invention disclosed in that application, the flap and marginal membrane portions are sealable by virtue of male and female interlocking fasteners carried on the respective membrane portions. The interlocking fastener structure may take various forms and may include an expandable section to accommodate field assembly.

In patent application Ser. No. 336,370, a prefabricated panel is disclosed which is ideally suited for roof construction. The panel utilizes a corrugated metal member as a structural core, and an exterior, weather resistant sheet material is pre-adhered to the panel exterior. The sheet msterial is formed with a flap along one or several edges which is adapted to overlie a marginal portion of an adjacent panel. A seal is effected between overlapping membrane members by vulcanization or by virtue of interlocking fasteners carried on the flap and the marginal portions of the next adjacent panel.

In any such system as described with respect to the referenced co-pending patent applications, the fasteners employed for connection to the panels in the field must be easily and quickly operated, and must provide an effective continuous seal such as against weather. However, in the fasteners employed in such systems male and female coupling members of different configurations are generally provided, and it is not uncommon for dirt to get into and along the inside of the coupling members of the fastener, particularly during field use. When such occurs, because of the relatively close fit of the coupling members of the fasteners, dirt is pushed and packed inside the fastener during joining of two fasteners until, in some cases, it is difficult to fully close the fasteners and a leak may occur between them.

In the construction system of the present invention, which is of the same general type as disclosed in the aforementioned co-pending patent applications, this problem is effectively eliminated or substantially reduced by providing a plurality of construction panels, each of which includes a core member, and an exterior sheeting or membrane member formed with a novel fastener disposed along each adjacent edge of the membrane member of adjacent panels for interlocking engagement therebetween. Each such fastener includes means for wiping along the inside walls of another fastener to be connected therewith to wipe away dirt accumulated thereon, and at least one dirt cavity is provided in the fastener for receiving the dirt as it is pushed from the inside walls of the fastener. The respective fasteners that are coupled together include male and female interlocking members and the dirt cavity is formed by making the female portion deeper than the extent of penetration of the male member. As the fasteners are joined, the male member of each fastener wipes down across the inside surface of the mating female members of the other fastener and dislodges dirt or dust on these surfaces to allow a good seal between the fasteners. If this dirt were not removed by this wiping process, it would form a permeable barrier and act as a channel to allow water, air, or other fluid to penetrate the fasteners by flowing through the channel.

In the form of fastener illustrated herein, the fastener is an elongated zipper of flexible material that includes a body portion having male and female coupling means, such as projecting ribs and intermediate grooves for interlocking engagement with an identical zipper on an adjacent panel. The zippers include a connecting web extending from the zipper body which may be bonded to the edge of each membrane member so that the zippers along two opposite edges of the membrane member face inwardly towards the panel, and the zippers along the other two opposite edges of the membrane member extend outwardly from the panel. The zippers can be disposed along their respective membrane member edges so that they slightly extend beyond these edges a sufficient amount so that when adjacent panels are abutting each other adjacent zippers are overlapped for proper engagement. Also, if desired, the membrane members can be provided with opposite flap and marginal portions along their edges as described in patent application Ser. No. 336,364, with the fastener of this invention disposed along each of these portions. Further, the expansion/contraction feature illustrated in that application may be utilized if the fasteners are not overlapped as described.

In designing fasteners of the type utilized in the present invention a difficult problem is to provide adequate sealing between the fasteners. This is particularly true where inclusion of some dirt which is not wiped away occurs, or a manfacturing defect occurs in a section of one of the fasteners.

In the process of manufacturing the fasteners of the present invention, it is more difficult to consistently get two large flat surfaces that mate continuously than it is to have one flat surface and one substantially knife-like edge surface mate continuously. This is especially true since the fasteners of the present invention are generally made of a somewhat flexible material that can deform slightly so that the total amount of pressure will be much more intense (force per unit area) if distributed across a substantially knife-like edge rather than if distributed across two more massive surfaces.

Thus, in order to ensure proper sealing, particularly in the instances noted it is preferred that several areas of intensive contact be formed by substantially line contacts (analogous to a knife edge) between the surfaces of the contacting fasteners instead of extensive contact between flat surfaces. By creating a number of lines of relatively intense contact between the mating surfaces, water can be effectively prevented from passing these contact areas.

It is also desirable, as noted, that the zippers be formed of a material which is sufficiently deformable under pressure to flow into voids in the areas of intensive contact to further aid in providing a watertight seal.

Each of the intense contact areas should be complete, continuous and of enough intensity to prevent the pressure of the water from forcing the surfaces of adjoining fasteners apart and from passing between those two surfaces. Also, by using multiple points of intense contact, even if dirt is not wiped from one area, or a manufacturing defect prevents adequate sealing in one area, other areas of contact will provide sealing.

An important feature of the present invention is that the fasteners employed can be readily designed to include these areas of intense contact. Also, the fasteners can be pre-shaped during manufacture so that they have a tendency to pinch together or close on themselves when mated together to increase the intensity of the contact in the areas of intense contact. A further feature of this invention is the provision of a system and process of manufacturing the fasteners to provide the pre-shaped fastener.

It is preferred that the fasteners of this invention (both the body and web portion) be made of an extruded flexible material, such as Hypalon (as hereinafter defined), which is normally of a thermoplastic state, and that the fastener be extruded in a configuration where its ribs are pinched-in towards each other. The flexible material should be adapted to respond to treatment whereby the body portion can be stiffened and permanently shaped to its extruded configuration by increasing its elastic modulus and permanent set without destroying the thermoplastic properties of the web portion. Following such treatment the ribs of the body portion are resilient and remain normally pinched in towards each other prior to mating with another fastener and have to be forced away from each other during insertion into another fastener. Because of their resilient properties they then pinch towards each other again enough after insertion to increase the sealing pressure with the mated fastener in the areas of intensive contact. This treatment to only the body portion of the fastener also permits it to withstand tension and compressive forces during usage which would otherwise cause it to fail, while permitting the web portion to be bonded to the flexible membrane of a panel, such as by a heat weld, as hereinafter described. In order to so stiffen and permanently shape the body portion of the fastener, without doing so to the web portion, it is preferred that an irradiation process using Beta or equivalent rays be used as hereinafter described in detail for curing and cross-linking the body portion only. As also disclosed herein the extruded fastener material may be irradiated only to the depth of the body portion either while a length of fastener material is coiled together, such as to facilitate packaging and shipping, or while the fastener material is provided in continuous strips moving past a radiation source in a continuous process.

In field use of the fasteners described, where many feet of structural panels may be joined together in a day, even with easily installed fasteners it is not uncommon for a small section of the fastener to be left unfastened, or only partially joined, so that a leak can develop. Even when the installed system is visibly inspected, it is easy to miss seeing the unfastened or only partially joined section or sections since the system is generally a large surface area of the same color.

In the construction system of the present invention, this problem is effectively eliminated by providing fasteners such as described which include at least one indicator means providing a distinctive visual indication when the adjacent fasteners are not fully and properly engaged. Preferably, this means is a stripe having a color different from the color of the remainder of the fastener. The color stripe on each fastener is located along an edge thereof that is exposed except when the fastener is fully engaged with an adjacent fastener so that a person inspecting the system after installation can readily detect sections of the connected fasteners not fully closed. A kick flap may be provided on each fastener or on only one of the fasteners for deflecting forces that would tend to separate the fasteners, and to cover the color stripe when the fasteners are properly fastened. By use of the kick flap, the color stripe can be positioned on the fastener so that it can be easily seen from above the fastener when installed, but not fully connected.

With the use of zippers such as described, it is also possible that they can be improperly engaged in by inserting a rib member in the wrong groove and this condition go unnoticed during visual inspection. Thus, in another embodiment of this invention, an elongated color stripe can also be provided along the length of that portion of any rib member that may be exposed when the ribs and grooves are improperly engaged as described. In this way, even if the color stripe along the edge of the fastener is covered, the second color stripe will be visible during inspection.

Various forms of dust caps may be provided for the fasteners of this invention to further aid in ensuring that the fasteners will seal together in the field despite the fact that they may be stored or used in an environment of dust and dirt. Generally the dust caps can be installed at the factory either before or after the fasteners are bonded to the construction panels, and removed during installation in the field. In usage of the pre-shaped fastener described it is preferred that a dust cap member be provided which projects into the grooves of the body member and causes the ribs thereof to spread open. Thus, when the dust cap is removed upon field installation the fasteners can be easily coupled with a similar fastener as the ribs will not immediately take their pinched configuration. It has been found, however, that in a short period of time the ribs of the fasteners will creep back to their pinched configuration to provide the advantages thereof previously noted.

Thus, by use of the novel zipper design disclosed and claimed herein, a construction system is provided which can be erected and installed efficiently and economically with a good chance that the integrity of the seal provided by the system will be greatly increased because dirt accumulated on the fastener elements will not normally impede proper connection of the fasteners, and areas of intensive contact between the surfaces of joined fasteners will be maintained. Also by use of the visual indicator described there will be good chance that the seal provided by the fasteners will be ensured even with only a casual visual inspection or "walking over" of the system during or after installation.

DETAILED DESCRIPTION OF THE DRAWINGS

In the drawings, wherein like reference numerals are used throughout to designate like parts, and wherein preferred embodiments of this invention are illustrated:

Figure 1:
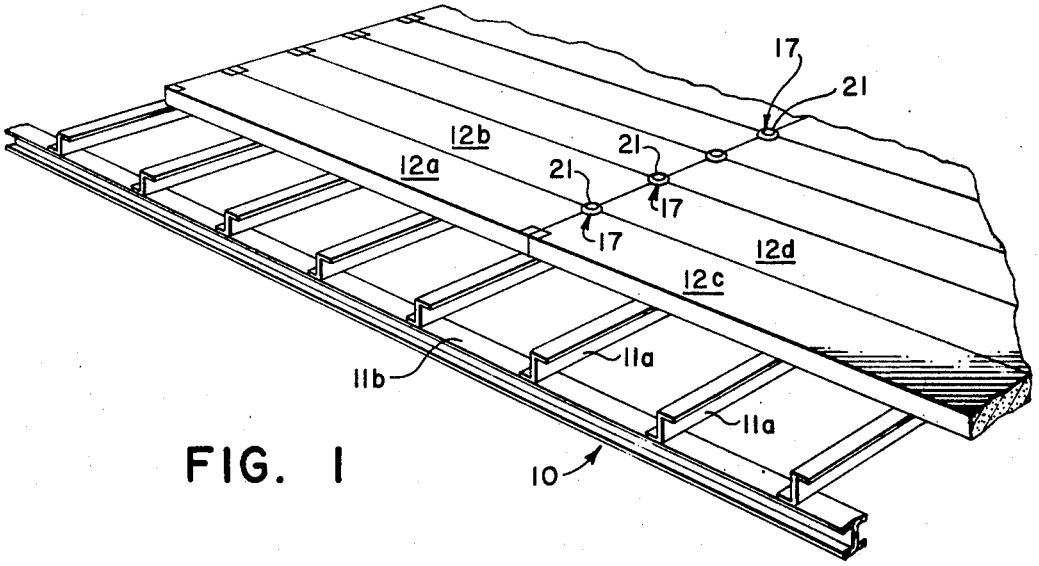
FIG. 1 is a perspective view showing a number of the panels of the present invention assembled to form a typical construction section, such as a roof.

Referring now to the drawings, FIG. 1 shows a construction assembly generally designated by the numeral 10 supported on an underlying series of parallel Z-shaped purlins 11*a* supported on a plurality of parallel beams or rafters 11*b*. Beams 11*b* are, in turn, supported on columns or bearing walls (not shown) as known in the art. For purposes of illustration, construction assembly 10 is shown in a horizontal position as representative of a typical roof structure. However, it should be noted that the assembly could as well be an exterior building or tank wall.

Figure 2:
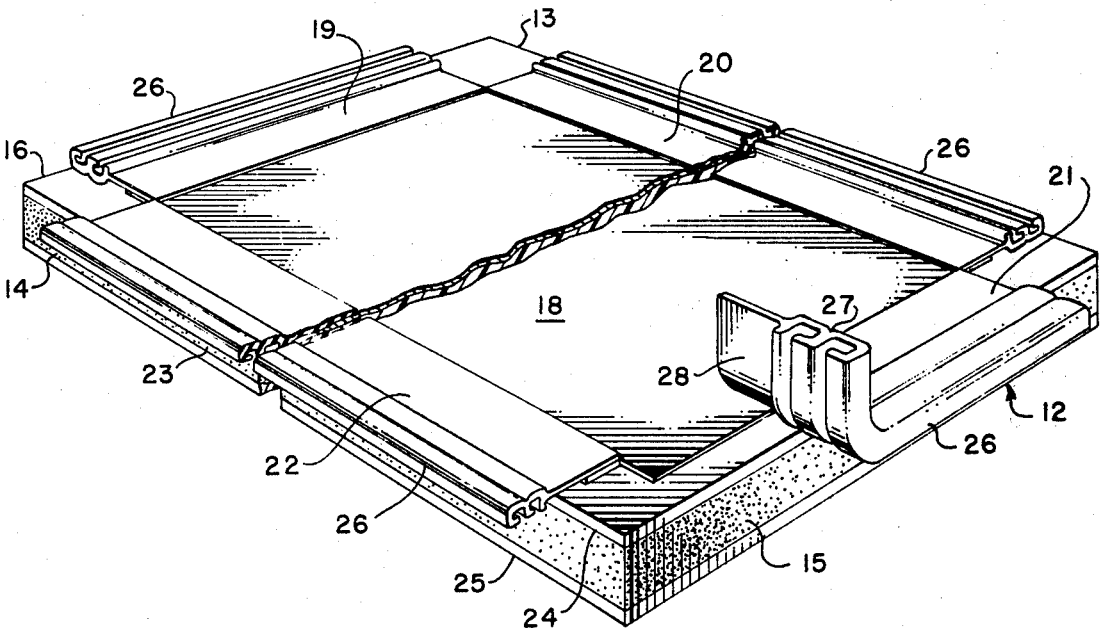
FIG. 2 is an enlarged perspective view of a single panel.

Construction assembly 10 includes a plurality of individual structural panels generally designated by the numeral 12 with the appended letters a, b, c and d used to denote separate panels of similar construction. The panels may, for example, be three feet wide by 20 to 40 feet long. In FIGS. 1 and 2, panel 12 is shown as being rectangular having opposite side edges 13 and 14 and opposite end edges 15 and 16. A number of similar panels 12 are contiguously aligned in a side-by-side and end-to-end arrangement to form assembly 10 with the individual panels abutting at common corner junctures 17. Panels 12 are covered with outer membrane sheet 18 of a weather resistant flexible material preadhered to the exterior surface, and membrane 18 includes edge portion 19, 20, 21 and 22 adapted to overlap with similar such edge portions of the next adjacent panel in a sealing relationship. The corner junction 17 of several panels may be sealed by a corner sealing structure 21*a*, such as the corner sealing structure illustrated in co-pending patent application Ser. No. 336,364, referenced above.

Referring to FIG. 2, the individual panel 12 may be formed having a structural core member 23 of a suitable material having good compressive, insulative, flexural and shear strength characteristics. For example, core 23 could be a polyurethane foam or a polystyrene. The upper surface of core member 23 is covered by sheathing member 24 and the lower or interior side of core member 23 is covered by sheathing member 25. Sheathing members 24 and 25 are typically a plastic or metal material suitably bonded or laminated to the opposite sides of core 23 which serve to give additional strength to the structure. Upper sheathing 24 also serves to provide a relatively hard, smooth underlay or surface beneath flexible membrane 18. Sheathing 25 may be provided with an appropriate decorative treatment when exposed within the building interior.

As noted, upper sheathing 24 is covered with membrane sheet 18 in the form of a weather resistant material to protect and seal the roof system 10. Membrane sheet 18 is substantially coextensive with the upper surface of the panel along its edges, except that its edge portions 19, 20, 21 and 22, including fasteners 26 as described in detail here, extend slightly beyond the edges 13, 14, 15 and 16 for overlapping relationship with similar such apparatus on an adjacent panel. For purposes of showing detail, fasteners 26 in FIG. 2 are slightly exaggerated in size in comparison with panel 12 since they are generally in the order of about ½ inch wide and ¼ inch high in the use illustrated. Membrane 18 is preferably a natural or synthetic rubber, or plastic, bonded or adhesively joined to the surface of upper sheathing member 24. Membrane 18, for example, may be a chlorosulfonated polyethelene material such as a material known under the tradename "Flex Seal" of B. F. Goodrich Tire & Rubber Co. or "Hypalon" a tradename of E. I. Dupont de Nemours Co., or a filled "Hypalon" material. Other material such as a flexible, light gauge aluminum or galvanized sheeting may be used as a material for the membrane.

Figure 3:
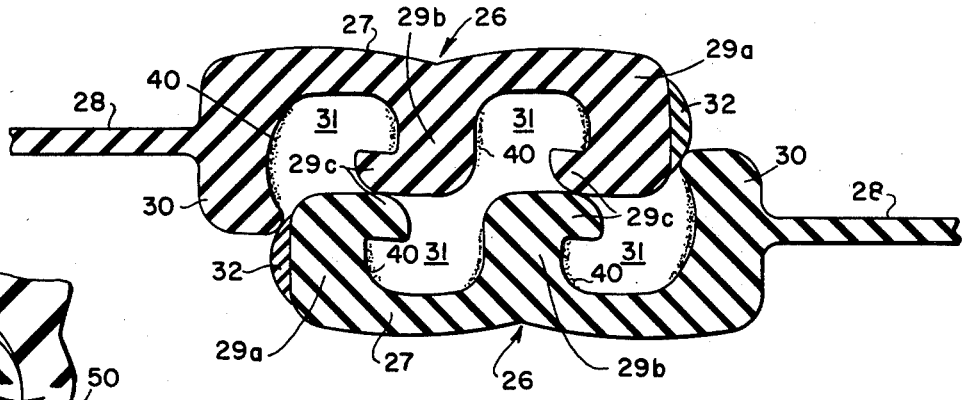
FIG. 3 is a sectional view of two fasteners of this invention just prior to joining.
Figure 4B:
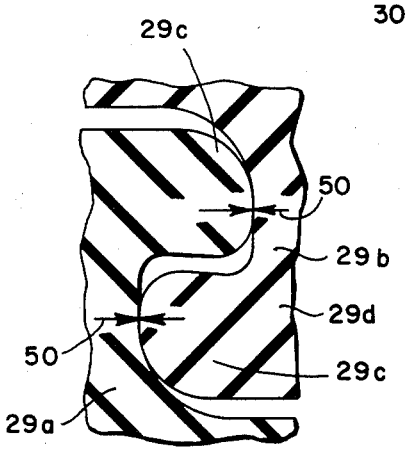
FIG. 4B is an enlarged view of a portion of FIG. 4A.
Figure 4A:
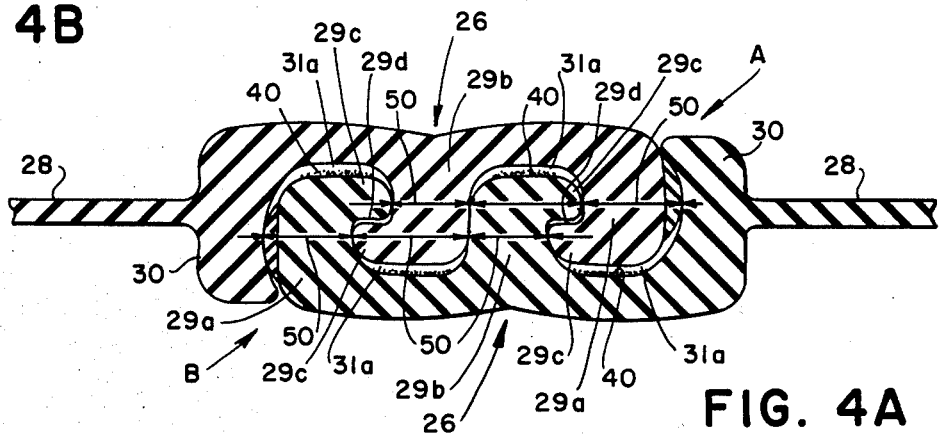
FIG. 4A is a sectional view similar to FIG. 3, but with the fasteners joined.
Figure 5:
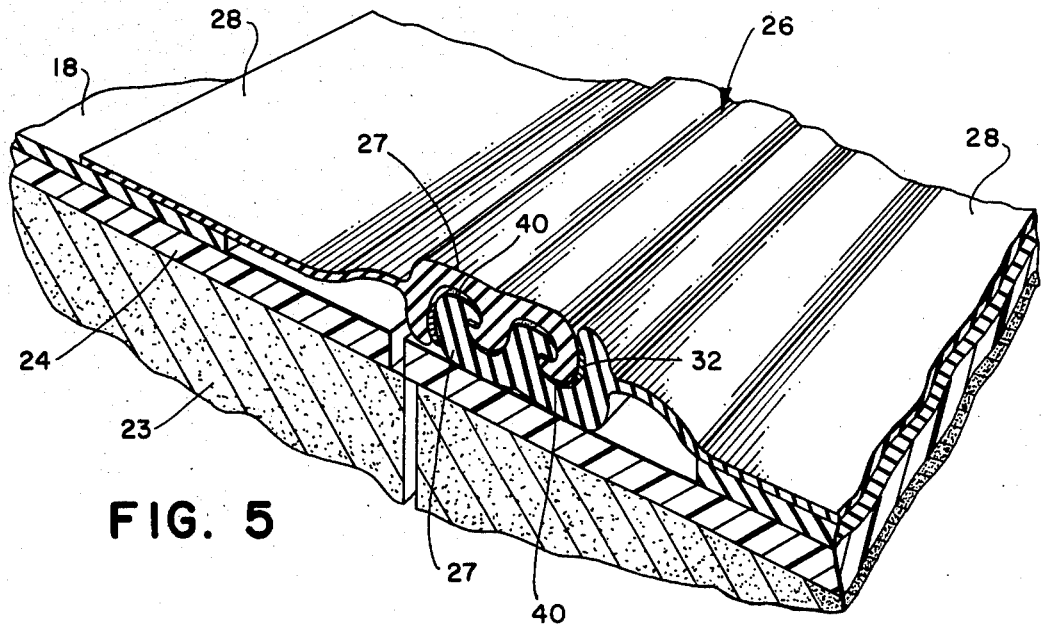
FIG. 5 is a perspective view showing adjoining fasteners of this invention connected to form a seal between adjacent panels.

Fasteners 26, which are shown in detail in FIGS. 3–5, are shown along either the longitudinal edges 20 and 22, or transverse edges 19 and 21 of membrane member 18. In either case, fasteners 26 may be identical except that along edges 21 and 22 they face downwardly from panel 12, and along edges 19 and 20, they face upwardly from panel 12. Also, along edges 19 and 20, fasteners 26 may extend only a small distance beyond edges 14 and 16 of panel 12, and fasteners 26 along edges 12 and 22 may extend beyond edges 13 and 15 of panel 12 a lesser amount as shown in FIG. 2, so long as the adjacent fasteners overlap each other so that they can be properly engaged when the adjacent panels carrying them are in substantial abutment.

Fasteners 26 include male and female coupling means, such as parallel, longitudinal ribs with grooves between them, as described below, and the ribs and grooves of fasteners 26 are adapted to interlock when force is applied, forcing the ribs into the grooves. The coacting sections are thus capable of being interlocked in zipper fashion to form a tight mechanical seal. Thus, fasteners 26 can easily be engaged by workmen as the panels are assembled to form a watertight seal. In some instances, an adhesive or vulcanizing agent can be applied between the coacting grooves and ribs at the time of securing the overlying membranes together to further ensure against penetration of moisture and seal the interior panel structure.

Various configurations of the male and female coupling means are suitable for the fastener arrangement. However, suitable configurations of fasteners 26 are shown as described with respect to FIGS. 3–8. In FIG. 3, two adjacent fasteners 26 are illustrated just prior to joining and in FIG. 4 they are shown in cross section as they would lock when joined.

Referring now to FIGS. 3–5, fastener 26 is illustrated as an integral structure which may be separately manufactured and bonded to membrane member 18 during construction of panel 12. Fastener 26 includes an elongated body portion 27 and an elongated, flat web portion 28 extending from body portion 27 and adapted to be bonded to and along an edge of membrane member 18, or if desired, directly to the panel if made of suitable material. Fastener 26 may be made in elongated strips, and the strips may be cut to the appropriate length for mounting on the membrane member to form each of the respective edges of member 18. Body portion 27 of fastener 26 includes parallel ribs 29 and, in the embodiment illustrated, two such ribs are provided, with a kick flap 30, and two grooves 31 formed by and between ribs 29 and kick flap 30. As illustrated, the outer rib is designated 29*a*, and the inner rib 29*b*. Ribs 29*a* and 29*b* include inwardly projecting tooth portions or hook-shaped extensions 29*c* for aiding in locking two such fasteners together when engaged. Body porton 27 therefore provides coupling means for interlocking engagement with similar coupling means on the adjacent fastener 26 on the adjacent panel 12.

Fastener 26 may be made of the same flexible material as membrane 18 and preferably should have at least the following characteristics:

(1) It can be formed, such as by extrusion, as an integral piece, including the body and web portion;

(2) The web portion should be adaptable to be easily and securely bonded to membrane 18 such as by the application of heat and pressure;

(3) The body portion should be adapted to be stiffened and permanently set in a desired shape and be sufficiently resilient to permit it to be distorted from the permanently set shape if required for insertion into a similar fastener and then returned to that shape;

(4) It should have good weathering characteristics in all types of environments to permit it to be used in year around outdoor service, and be adapted to be fireproofed, (5) It should have good tensile and compressive strength to permit it to be walked over and subjected to high wind loads, and (6) It should be of a pleasing color or adapted to be made of such a color.

It has been found that the referred to "Hypalon" or "filled Hypalon" material meets all of these requirements and is preferred as the material for fastener 26.

As used in this application, the term "Hypalon" or "filled Hypalon" shall mean a material that includes as major ingredients, chlorosulfonated polyethylene, at least one stable polymer extender or filler, and various processing and milling aids if desired. Any inert filler material such as titanium-dioxide, carbon-black, ground clay and the like can be utilized as the polymer extender. Various processing and milling aid materials that are compatible with the chlorosulfonated polyethylene material can be utilized in the instant compositions that are referred to as "Hypalon" and "filled Hypalon" throughout this specification. Normally, the chlorosulfonated polyethylene will be an unvulcanized state.

As shown in FIGS. 3 and 4A, ribs 29*a* and 29*b* are of such lengths with respect to grooves 31 so that when the adjacent fasteners are engaged as in FIG. 4, a small dirt cavity 31*a* is formed in each of grooves 31 between the end of the rib projecting into the groove and the inner end or bottom wall of the grooves. Also, its preferred that a small clearance 29*d* be left between inwardly projecting extensions 29*c* to accommodate dirt that may be on the adjacent edges of projecting extensions 29*c*. Otherwise, the mating rib and groove elements are designed to have an interference or close fit to seal between them, preferably along the areas indicated by the arrows 50 in FIG. 4A to establish substantially lines of intense contact as further described below. FIG. 4B and FIGS. 6–8 show this feature in more detail.

Thus, with the construction as illustrated, if dirt (shown generally as 40) accumulates on the inside walls of a fastener 26, as it is joined to another fastener 26, the ribs 29*a* and 29*b*, and particularly extensions 29*c* of each fastener, and the outside surface of rib 29*a*, will wipe along the adjacent inside wall of the other fastener to force the dirt down into cavities 31*a*, and since the cavities are present, permit the fasteners to be engaged with little or no inteference. The size and depth of the dirt cavities formed can vary as long as the structural integrity and sealing effectiveness of the fastener is nor impaired. For this purpose, the thickness of the hook-shaped extension 29c in the direction in which the rib member extends is substantially less than the depth of grooves 31 to permit cavity 31a to be formed.

This relationship also allows ribs 29 be inserted into grooves 31 without the outside of the ribs interfering with the inside grooves prior to complete insertion. This feature allows the fastener to be assembled without compressing either the rib or groove material prior to complete insertion and is an important feature because it is easier to build up the forces required for effective sealing at the side of the ribs through stretching the grooves than it is by direct compressive force at the end of the rib against the bottom of the groove.

With this arrangement the only forces that must be overcome in closing the fastener are the frictional force between the two more or less vertical surfaces where the ribs and grooves come into contact during the sliding insertion, and the force required to open the area about hook-shaped extensions 29c of one fastener so that the hook-shaped extensions 29c of the other fastener can be inserted in groove 31. The use of a lubricant in conjunction with the fastener described insure that these forces are relatively minor in comparison to the force required to compress the material in a fastener where the ribs compress the bottom of the grooves. Also, since in the arrangement illustrated in FIG. 4A bottoming compressive forces are not present to interfere with the sealing relationship between the sides of the ribs and grooves, the intense contact feature referred to and explained in detail below can be provided without interference caused by distortion of the groove material.

As previously noted, it is preferred that the sealing between the fasteners be provided by a plurality of intense, substantially line contacts in the area indicated by the arrows 50 to provide a series of dams that prevent leakage through the fastener. In this manner should one of these dams fail, then one or more of the other dams provided will prevent the passage of water through the fasteners. For example, in FIG. 4A, water passing from the area A to the area B must pass by a series of eight such dams represented by the head-to-head abutment of arrows 50.

Figure 6:
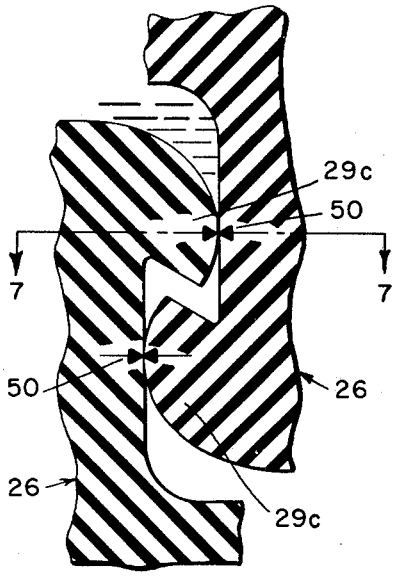
FIG. 6 is a partial sectional view through a configuration of fasteners of this invention emphasizing the intense contact feature.
Figure 7:
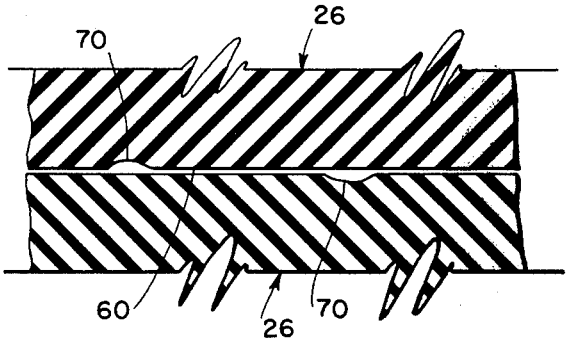
FIG. 7 is a sectional view taken at 7—7 in FIG. 6.

In FIG. 6 the construction of ribs 29 and hook-shaped extension 29c is such that the area of intense contact indicated by arrows 50 is enhanced. The reference numeral 60 represents this area which has the effect of substantially a line contact as shown in FIG. 7. In FIG. 7 it is assumed that there are irregularities 70 in the surface of each of the mating members along the length of area 60 in which the intense contact is to be provided. If the area 60 of contact of the members is substantially along a line, instead of a large flat area, and the fasteners are made of a deformable material, the material in the areas 60 will flow together to fill voids 70 created by the surface irregularities when pressure is applied urging the mating surfaces together, as in FIG. 8. Also, with a substantial line contact the intensity of the mating force will be substantially greater and the sealing more effective than with the same force applied to a greater contact area. As noted, the provision of multiple dams by providing several areas of intense contact is advantageous in that if one of the dams fails because of a misfabrication in the fastener material, or because a dirt particle has been lodged at one of the intense pressure dams, the next dam will prevent the water from completely traversing across the full width of the zipper.

Figure 8:
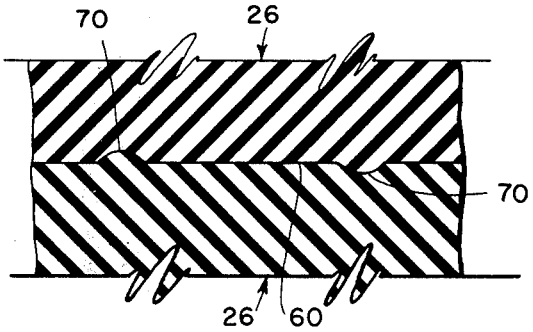
FIG. 8 is the same view as FIG. 7 illustrating the fastener material under pressure.
Figure 17:
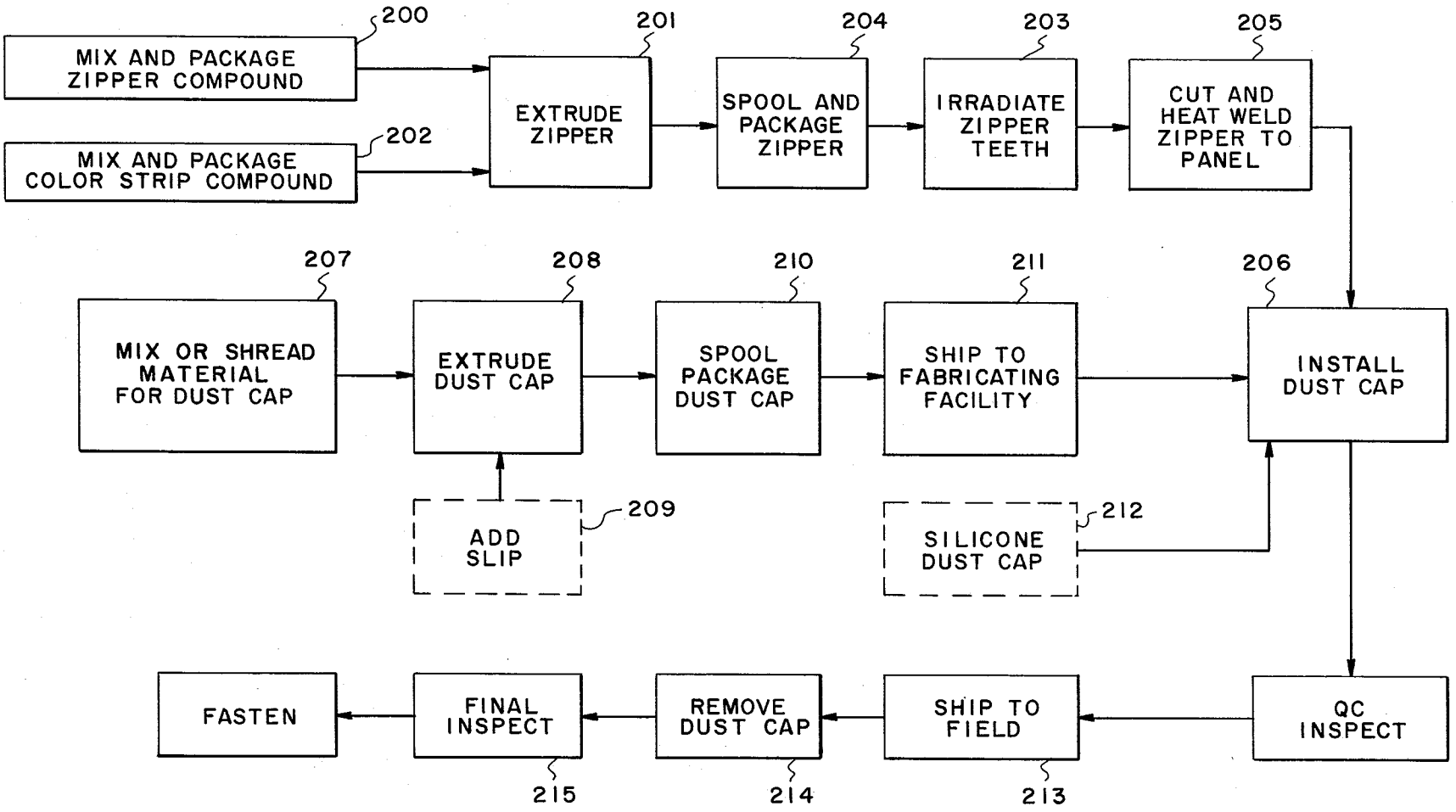
FIG. 17 is a flow diagram of one form of the manufacturing process of the fasteners of this invention.
Figure 18:
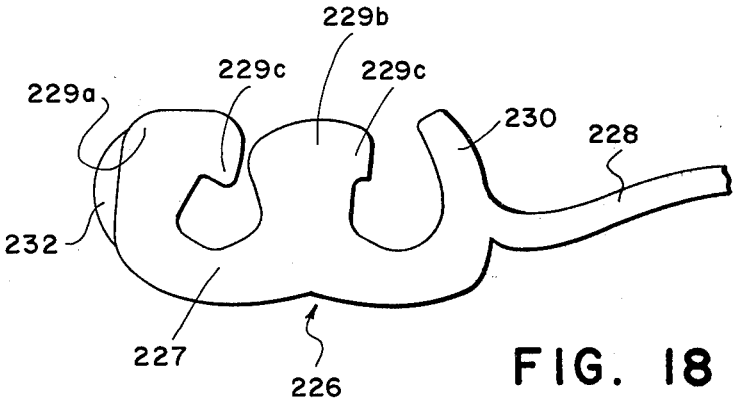
FIG. 18 is an end view in elevation of a pre-shaped fastener of this invention.

FIG. 18 illustrates a fastener identical to those of FIG. 3, except that it has been pre-shaped during manufacture to provide a force continuously urging ribs 29a and flap 30 toward each other. Thus, when the fasteners are engaged, the hook-shaped extensions 29c are urged by a predetermined force into sealing contact along a substantially line contact as shown in FIGS. 6–8. The pre-shaping of the fasteners insures that the intensity of the area of contact be sufficient and continuous to provide an effective seal. FIGS. 17 to 24 illustrate the process of manufacture of such a fastener and FIGS. 32 to 35 illustrate its field utilization.

Thus, a construction system is provided by the present invention which provides for ready connection and sealing of adjacent panels of the system even where one or more of the coacting fasteners may have dirt accumulated inside of it prior to installation, along with an adequate and continuous weatherproof seal. With the present invention, the amount of dirt inside the fastener that can be wiped into the dirt cavities to permit proper fastening may be sufficient so that many field installations are made possible where they would otherwise not be possible, and multiple areas of intense contact can be provided to insure the seal provided by the fasteners.

Another important feature of this invention is that a colored stripe, such as provided by a strip 32 of material having a color different from the rest of fastener 26, may be provided along the outer edges of each of fasteners 26 as described below. In this case, the outer edge of strip 32 of one fastener will wipe along the adjacent inside surface of the grooves 31 of the other fastener into which it fits.

Figure 9:
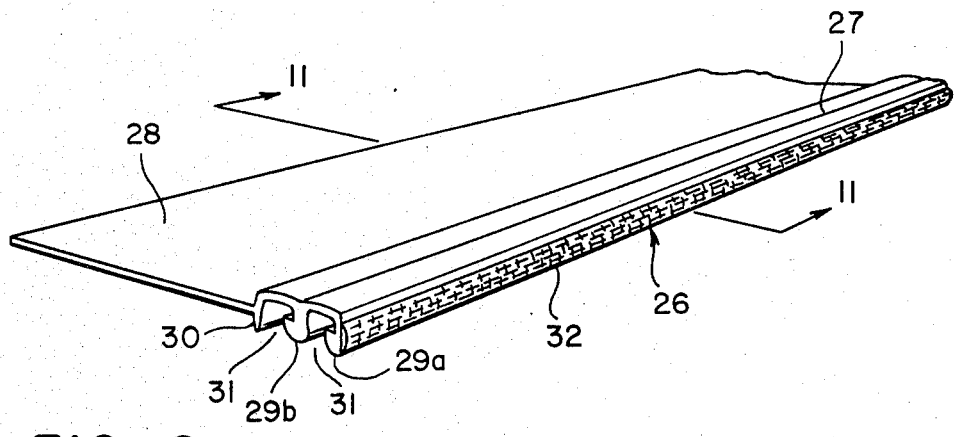
FIG. 9 is a perspective view of one embodiment of the fastener of this invention employing the color stripe.
Figure 10:
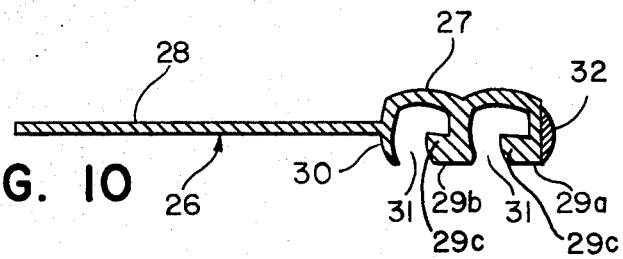
FIG. 10 is a sectional view taken at 11—11 in FIG. 9.
Figure 11:
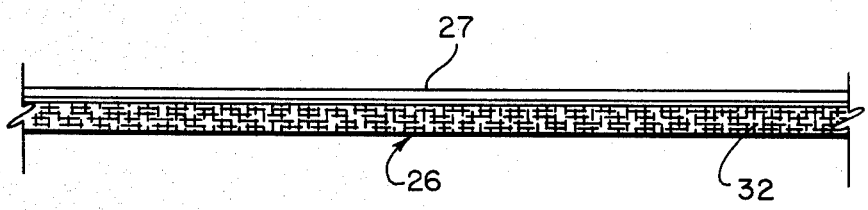
FIG. 11 is a side view of the FIG. 10 fastener.
Figure 19:
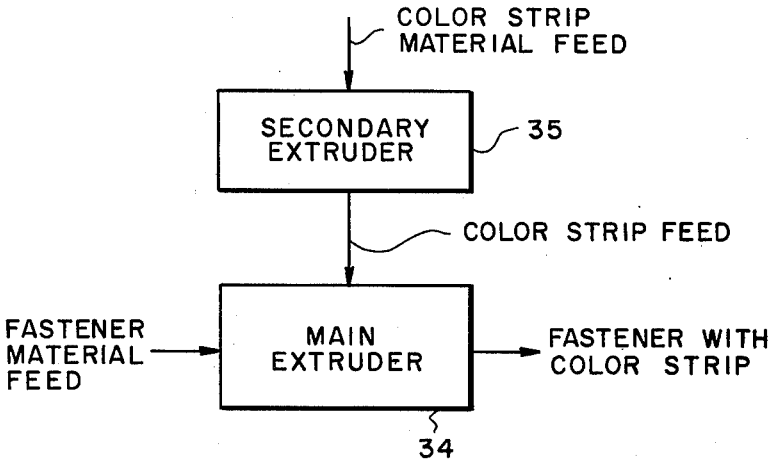
FIG. 19 is a diagrammatic view of one form of the process of extruding the fastener of this invention.

Referring now to FIGS. 9–16, various forms of fastener 26 are illustrated as employing color stripes, which function as an indicator means for providing a distinctive indication when adjacent fasteners on adjacent panels are not at least substantially fully engaged or interlocked, during or after installation. This means is such that by visual inspection of the construction system during or after installation, it can be readily determined whether or not the respective fasteners are fully engaged, which is necessary to provide and maintain the required moisture seal. As illustrated in the embodiment of FIGS. 9–11, this means preferably includes a color stripe such as provided by an elongated color strip 32 integral with or bonded along the entire length of the outer edge of rib 29a. For example, sections 27 and 28 of fastener 26 may be beige or white in color, and color strip 32 may be yellow or red, or some other color which is distinctive of the color of the remaining parts of the fastener. As illustrated in FIG. 19, during the manufacture of fastener 26, as the fastener is extruded through a main die extruder 24, a color strip material, which may be a material different from the remainder of fastener 26, for example, pigmented polyethylene, may be fed from a secondary extruder 35 on stream into extruder 34 so that the color strip material displaces fastener material along the outer edge of rib 29a. The amount of material so displaced can be controlled by controlling the pressure of the color strip feed, as the color strip and fastener are co-extruded.

Of course, the color stripe can be provided by a different color along the length of the outer edge of rib 29a without the use of the separate color strip material.

Figure 12:
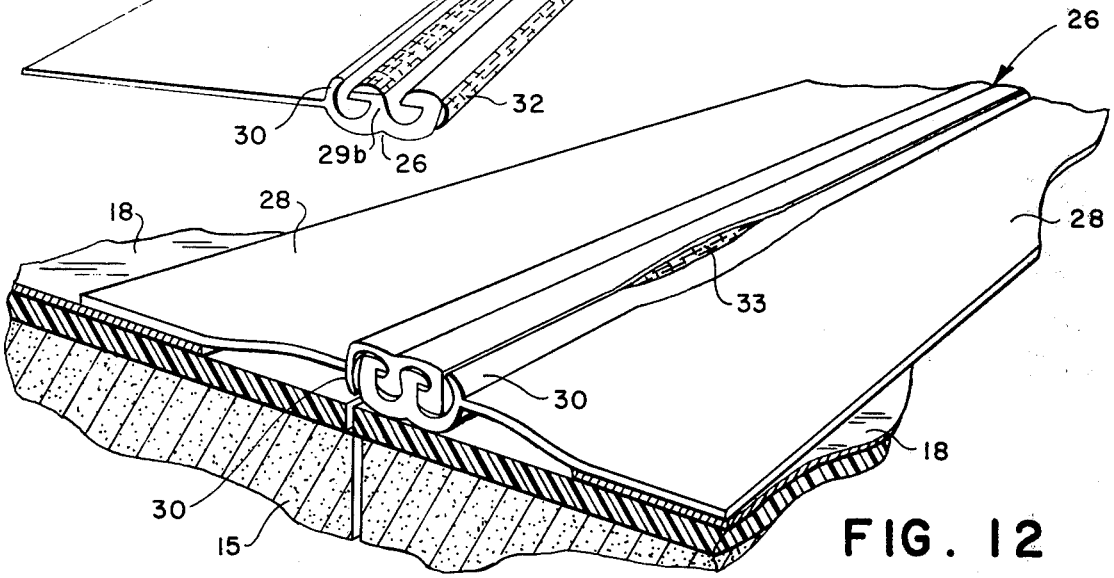
FIG. 12 is a perspective view showing adjoining fasteners of this invention with a section thereof not fully joined.
Figure 13:
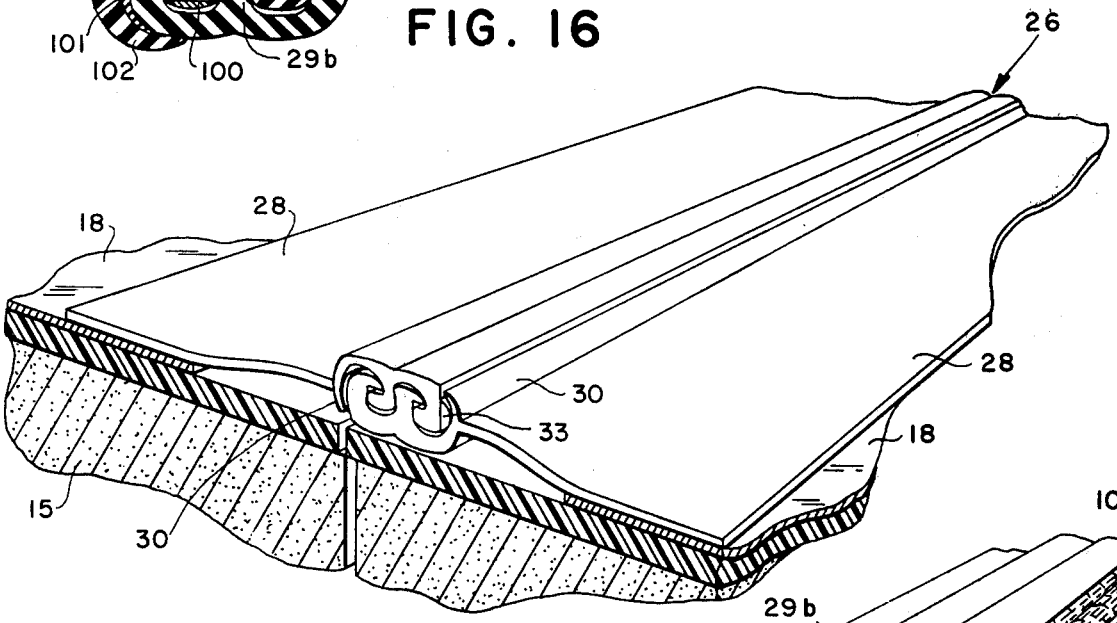
FIG. 13 is the same view as FIG. 14 but with the fasteners fully joined.
Figure 15:
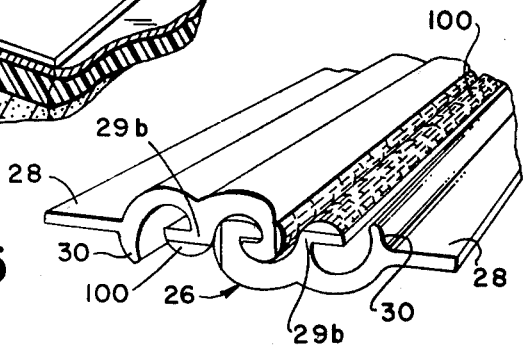
FIG. 15 is a view illustrating of the manner in which the additional color stripe of FIG. 14 indicates improper connection of the fasteners.

Referring now to FIGS. 12 and 13, illustration is provided of the manner in which color strip 32 provides the distinctive indication of improper or incomplete connection between adjacent fasteners 26. As illustrated in FIG. 12 wherein a portion along the length of the connection between adjacent fasteners 26 is illustrated as only partially closed, color strip 32 would clearly be visible to a person inspecting the system and steps can be readily taken to complete the closure. FIG. 15 illustrates the manner in which adjacent fasteners 26 appear when properly and completely installed. As shown in FIG. 15, kick flap 30 of each of the fasteners extends over color strip 32 to substantially or completely cover it up. By use of such a kick flap, which also function to deflect forces that would otherwise tend to cause the fasteners to separate, and to add further protection against weather, color strip 32 can be positioned along the outer edge of rib 29*a* so that it is exposed from above panel 12, and can be readily seen by a person looking at the panel, when kick flap 30 does not properly cover color strip 32, indicating in turn that fastener 26 is not properly interlocked.

Figure 14:
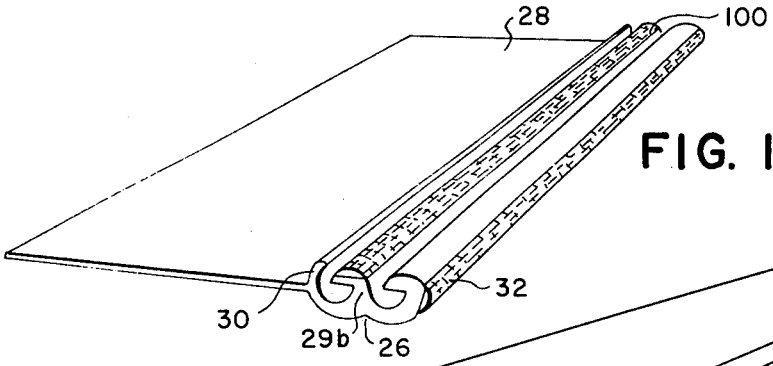
FIG. 14 is a view elevation of another embodiment of the fastener of this invention which includes a color stripe along an intermediate rib thereof.

Referring now to FIGS. 14 and 15, another embodiment of the fastener of this invention is illustrated in which a color stripe 100 is provided along the edge of intermediate rib 29*b*. As illustrated in FIG. 15, it is possible during engagement of fasteners 26 to inadvertently place rib 29*a* into the groove 31 furtherest from web 28. Since to do so would at least partially, if not completely, cover color stripe 32, the provision of color stripe 100 insures that a person making a visual inspection of a construction system of this invention would be alerted to the condition of FIG. 15. FIG. 13 illustrates the correct relationship of the fasteners 26 in which both color stripes 32 and 100, if it were provided along rib 29*b* (color stripe 100 not being shown in FIG. 13), of each fastener would be covered by the other fastener.

Figure 16:
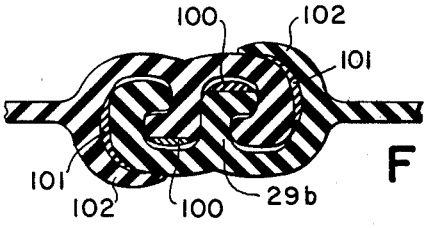
FIG. 16 is a sectional view in elevation of another embodiment of the fastener of this invention which includes a color stripe.

FIG. 16 illustrates another form of the present invention wherein each of the fasteners 26 includes a color strip such as provided by color stripes 101 and kick flaps 102 which extend up and over the outer ribs of the fasteners to permit visual inspection through a wider angle than is possible with the embodiment of FIG. 9.

Thus, a construction system is also provided by the present invention which provides for ready connection and sealing of adjacent panels of the system and permits visual inspection of the system during or after installation to determine whether or not the seal between adjacent panels has been fully completed. Because of the distinctive color of the color stripe, visual inspection can be readily made and the chances that sections of the fastener not completely installed will be missed during such an inspection are greatly reduced.

Also, while the fastener of this invention is illustrated as part of a roof assembly, it can, of course, be utilized with other types of assemblies, including adjacent sections connected together to provide a continuous seal between the sections.

Referring now to FIG. 17, a complete process of manufacturing a pre-shaped fastener such as shown in FIG. 18 is illustrated, as are the steps involved in coupling the fastener to a construction panel and the steps involved in field installation of the panels. FIGS. 19 to 24 illustrate in more detail some of the steps of the manufacturing process and FIGS. 32 to 35 illustrate in more detail steps involved in the field installation.

In the process of manufacture of the fastener of FIG. 18, the fastener compound is combined and mixed as represented by box 200 and then extruded at box 201 as the fastener body material. If a color stripe is to be provided the material for it can be mixed and combined as illustrated by box 202 and then extruded together with the fastener material at 201 as illustrated in FIG. 19. In the process of FIG. 17, it is preferred that the extrusion die have a configuration so that the pre-shaped or pinched fastener 226 of FIG. 19 is provided including a body portion 227, web portion 228, ribs 229*a* and 229*b* each having a tooth 229*c*, kick flap 230, grooves 231, and a color stripe 232. In the fasteners of FIG. 18 rib 229*a* and kick flap 230 extend towards each other partially closing the opening into each of grooves 231, and it is preferred that these openings not be completely closed but that there be enough "pinching" together to effectively increase the pressure applied in the areas of intense contact previously described. However, as extruded, the fastener material (both body portion 227 and web 228) is generally relatively soft and pliable and it is also preferred that a step be provided in the manufacturing process wherein only the body portion of the fastener is stiffened and permanently set, and its modulus of elasticity increased, without changing substantially the properties of the web portion.

Figure 20:
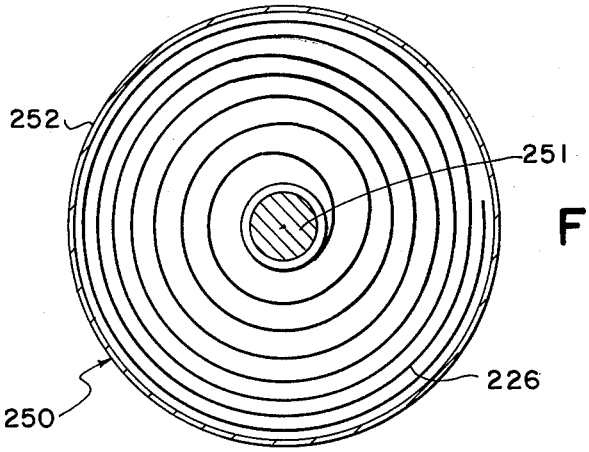
FIG. 20 is a top view in elevation of a length of fastener material coiled together for packaging and for irradiation.
Figure 21:
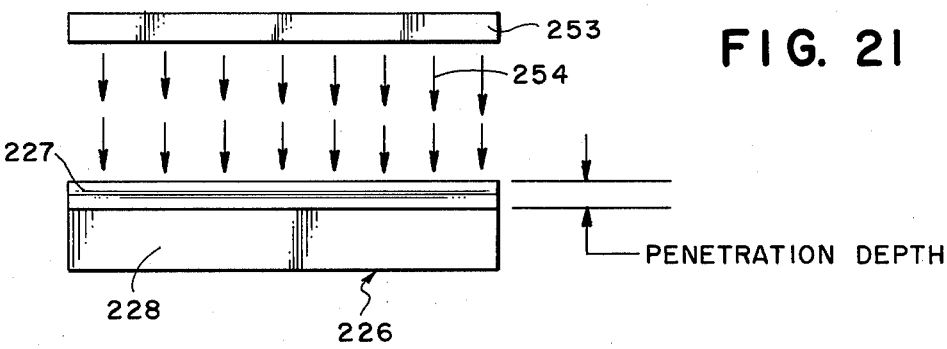
FIG. 21 is a side view in elevation showing the irradiation process when the fastener material is handled in the coiled form of FIG. 20.
Figure 22A:
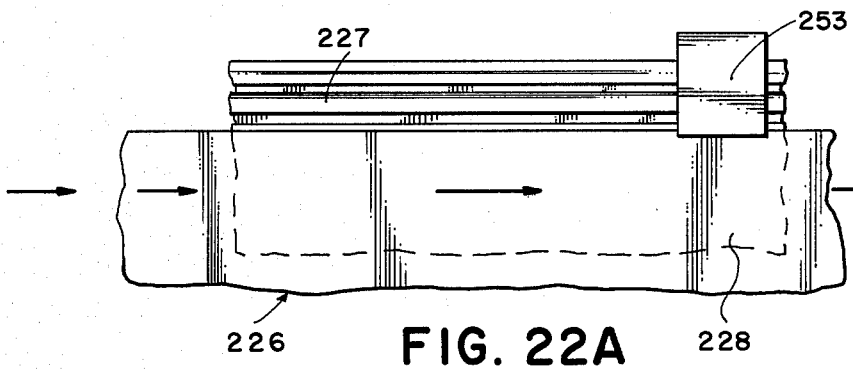
FIG. 22A is a top view in elevation showing the continuous irradiation with the fastener material in a continuous moving strip.
Figure 22B:
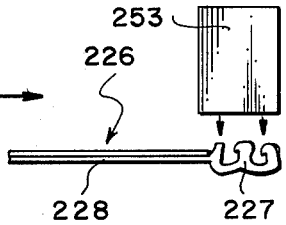
FIG. 22B is an end view of the apparatus of FIG. 22A.

For this purpose, it is preferred that the body portion of the fastener, but not the web, be irradiated with Beta or similar rays as illustrated by box 203 in FIG. 17 and as shown in detail in FIGS. 22, 22*a*, 22*b* and 22*c*. In the case where the extrusion of the fastener and the irradiation steps occur at two different locations, it is preferred that a length of extruded fastener material be spooled in spools of a predetermined radius (box 204 in FIG. 17 and FIG. 20) to facilitate packaging and shipment as well as irradiation as shown in FIG. 21. As shown in FIGS. 20 and 21, by so spooling the fastener material onto a spool 250, including a center core member 251 and an outer protective shell or flange 252, the spool can be placed flat in a box (not shown) for shipment and then taken from the box and placed flat under an irradiation source 253, with the body portion being under or adjacent the irradiation source, for the irradiation step, so that Beta rays 254 will penetrate only body portion 227 of fastener 226 and will not penetrate into web 228. For this purpose, although conditions may vary and cause adjustments in the required dosage, it has been found that irradiation dose of about 10 megarads, provided by a Beta electron beam of about 1.23 MEV in a single irradiation pass has been adequate to provide the desired change in the properties of the fastener resulting in increase in the elastic modulus and permanent set of the body portion of the fastener. By utilizing this step the desired durability and strength characteristics of the fastener previously discussed are also provided.

This occurs because the material becomes cross-linked and begins to behave very much as a rubber. The quickness with which the zipper "snaps back" becomes extremely important in certain instances when the zipper is under a negative tolerance which occurs when the zipper is stretched. Without the ability to so "snap back" (i.e. to return to its pinched-in shape to re-establish the lines of intense pressure contact), leakage can more readily occur through the zipper, particularly if it is stretched.

For a given requirement it will be necessary to determine the appropriate radiation level to secure the desired compromise between the elasticity, or stiffness, weatherability and other desirable and undesirable characteristics affected by irradiation. The intensity of irradiation is varied by varying the voltage, megarad level, or the duration of exposure. Of course, as previously noted, during the irradiation process, it is necessary to cross-link the zipper teeth while protecting the web of the zipper from cross-linking so that the web be heat and/or solvent welded to the Hypalon on the panel. It is also desirable to maintain the web in a thermo plastic state so that the web is free to stretch or release as the panel system as a whole expands and contracts.

In spooling a length of fastener material for the irradiation step described, a convenient size for the spool may be from two to four feet in diameter. Also, in order to insure substantially uniform physical properties of the body portion of the fastener after irradiation, the fastener material should be spooled in such a way that the top edge of the body portion when oriented as shown in FIG. 21 is flat within ±1/16 inch when viewed from the axis of the spool.

Where the fasteners are extruded and irradiated at the same location, it may be desirable to provide a continuous process for irradiating a length of fastener material 226 as it is moved longitudinally along a path beneath a stationary source of irradiation 253. For this purpose means such as a conveyor 255 employed to move the fastener material beneath the irradiation source 253, and a shield plate 256 may be provided to shield rays from web portion 228 of the fastener. The body portion of the fastener is adjacent the irradiation source and the irradiation rays are controlled so that rays pass substantially only through the body portion of the fastener.

Figure 23:
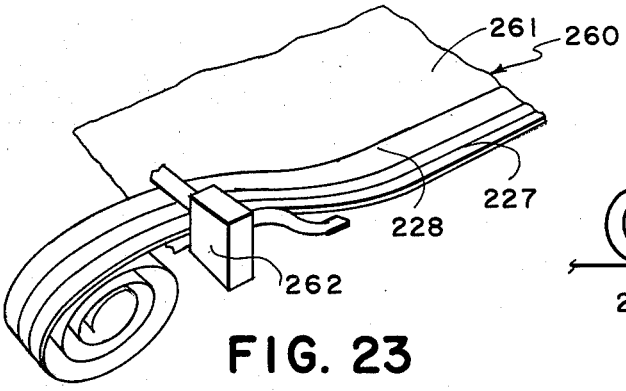
FIG. 23 is a perspective view in elevation showing the process of heat welding the fastener material to a fabricated roof or wall panel.
Figure 24:
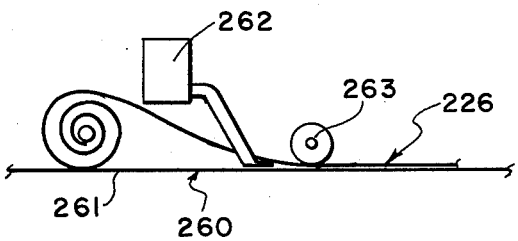
FIG. 24 is a side view of the apparatus of FIG. 23.

Referring now to FIGS. 23 and 24, the steps involved in heat welding the irradiated length of fastener material to a construction panel, which steps are presented by box 205 in FIG. 17, are illustrated. As shown in FIG. 23, a length of fastener material 226, is cut to the length of a panel 260 including a flexible membrane member 261 of Hypalon or similar material. As the length of fastener material is layed along the edge of membrane member 261 heat is applied such as by a heat gun 262 to both the outside surface of membrane member 261 and the lower surface of web 228 to cause the members to heat weld together. In addition, pressure is also preferably applied such as by a roller 263 to aid in the described process, and if necessary solvent can be added to somewhat soften the web and aid in the process of the web to the panel, particularly where the irradiation rays may have penetrated part of the web. The heat welding process is repeated for each edge of panel 260 so that a panel with fasteners along each edge such as shown in FIG. 2 is provided.

Referring now to box 206 of FIG. 17 and FIGS. 25 to 31, it is preferred that some sort of dust cap be installed within the ribs and grooves of fastener 226 to provide the following functions:

1. Transfer lubricant to the zipper in such a manner that the lubricant does not contaminate the panel materials prior to the completion of fabrication;

2. Prevent dirt from contaminating the zipper to such an extent that it must be cleaned prior to zipping. This should not be confused with the function of the self-cleaning or dirt cavity features which will accommodate small quantities of contamination; and 3. Prevent deformation of the zipper during crating and shipping so that the zipper can be properly closed when installed. It should be noted that the weight of the panels in the crate, if concentrated on an open zipper, will deform it temporarily to the point that either heat must be applied or excessive time will be required for it to return to its correct and intended shape.

The process of manufacturing the dust cap is shown in boxes 207 to 212 in FIG. 17, and is self-explanatory. However, in box 209 a step may be provided for adding a lubricant or some compound having a lubricating function in the extrusion step to aid in coupling two fasteners together during field installation. One suitable compound for the lubricant is known in the extrusion art as "slip". The addition of a lubricant at this stage of the process is optional, although preferred, and, as illustrated by the dotted line box 212, silicon or a similar lubricant can be utilized to coat the dust cap after manufacture and prior to installation into a fastener. In this case the fastener is lubricated by the transfer of the lubricant from the dust cap to the fastener. When "slip" is used for the lubricant in the extrusion process, it is added to the dust cap and migrates from the dust cap to the zipper. Of course, both lubricating steps may be employed to insure that a coating of lubricant is present in the fastener during field installation.

A further advantage of using "slip" in some cases is that it has a tendency to bloom out of the fastener material after a period of time. This blooming out allows the fasteners to be easily joined initially, however, as the lubricant blooms out, the surface co-efficient of friction increases making it more difficult to separate the fasteners and the fasteners are more resistant to physical abuse that could cause separation. In contrast, with the use of silicon as the lubricant only the mechanical connection between the fasteners is relied on for the seal. Also, should any portion of the lock portion of the fastener not be coated with silicon then it is very difficult to couple the fasteners together. If desired, "slip" could also be added to the extrusion process for the fastener.

Figure 25:
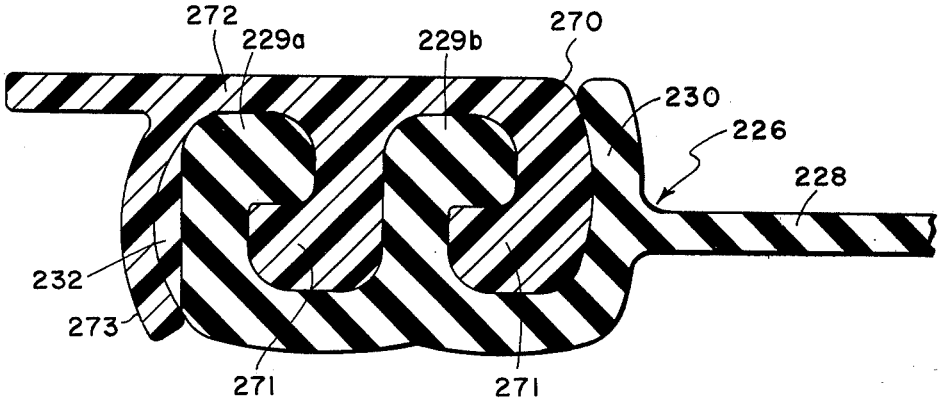
FIGS. 25 to 31 are different forms of dust caps which may be used with the fasteners of this invention.

The dust cap may take many different forms depending on the environmental conditions to which the fastener is exposed. In FIG. 25, fastener 226 as illustrated with a dust cap 270 including ribs 271 inserted into the grooves of fastener 226, and a laterally projecting flange member 272 which can easily be grasped as a handle to permit removal of the dust cap when desired. Also, an outer flange 273 extends about color stripe 232. Of course, it is understood in FIG. 25, as well as the other views illustrated in cross section in FIGS. 26 through 32, that dust cap 270 is an elongated strip of material corresponding to the length of fastener 226 and is preferably inserted into the fastener upon completion of manufacture and then removed in the field just prior to connection of the fastener to a similar fastener.

Since the dust cap is only used temporarily, and may be reused, and does not have to withstand weather or the forces that the fastener will be subjected to when used in the field, it may be manufactured of most any suitable material. For example, such relatively inexpensive material as polyethylene or used Hypalon (or similar material) which has been rejected in the manufacturing process of the fastener may be used. For example, during the manufacturing process, after extrusion or during quality control inspection (represented by box 208 in FIG. 17) fastener material may be rejected for a number of reasons and mixed together to be utilized as the dust cap. When this is done, because of the color addition for the color stripe, material may come out pink or various shades thereof instead of its normal white color, however, since the dust cap is only used for protective purposes, the material can still be used in this form. It is preferred that the dust cap be extruded as shown by box 208 in FIG. 17.

The dust cap illustrated in FIG. 25 is preferred for a number of reasons. First of all, when it is installed it serves to separate and spread out the projecting ribs and kick flap of the pinched-in form of fastener illustrated in FIG. 18, which aids in the connection of the fastener to a similar fastener in the field as described with respect to FIGS. 32 to 35. Also, it completely fills the grooves of the fastener. Thus, should the fastener be used in an environment where moisture in the grooves would freeze, (thus making installation very difficult) moisture will be effectively kept from entering the grooves. Also since the entire surface of the fastener which contacts and mates with another fastener when connected therewith is protected and covered by a dust cap, the accumulation of dirt on these surfaces will be held to a minimum prior to installation in the field.

Figure 26:
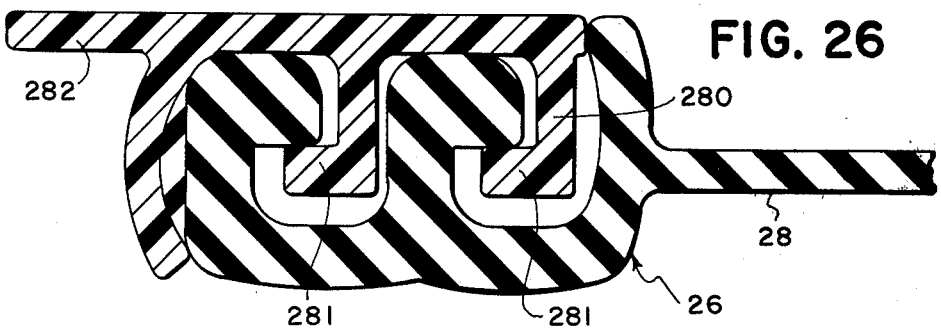

However, in those instances where the environment is such that the problem of freezing of accumulated moisture is not present and less dirt accumulation is expected, the dust cap 280 illustrated in FIG. 26 may be utilized. As shown therein, the primary objective of this dust cap is to block the openings in the grooves of the fastener which is in this embodiment is illustrated as a fastener 26 taken from FIG. 3 of the drawings. It is preferred that dust cap 280 not be used with the pre-shaped form of fastener of FIG. 18 since it would not serve to spread open the fastener prior to installation as would the dust cap of FIG. 25. Dust cap 280 includes projecting rib members 281 and a laterally projecting flange 282 to serve as a handle to permit it to be readily removed and inserted into the fastener.

Figure 27:
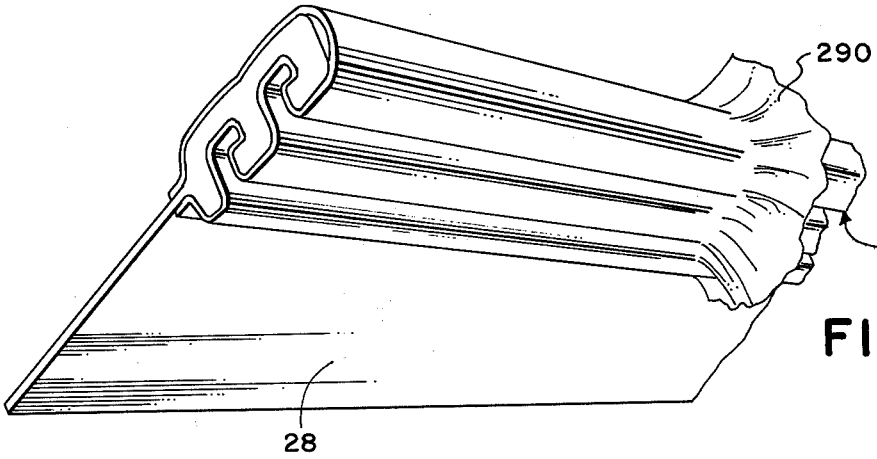

Referring now to FIG. 27, a still different form of dust cap is illustrated and it is preferred that this dust cap be used with the fastener 26 of FIG. 3 as it would not serve to spread open the pre-shaped fastener of FIG. 18. As illustrated in FIG. 27 a polyethylene or similar flexible sheath 290 can be placed over the locking members of the fastener during the manufacturing process and peeled back off from the fastener during field use and prior to zipping of the fasteners together. Dust cap 290 is particularly effective for insuring that the locking members of the fastener are entirely free of dirt and dust accumulation prior to installation; however, since it increases the complexity of manufacturing the fastener it is less preferred than the dust caps previously described.

Figure 28:
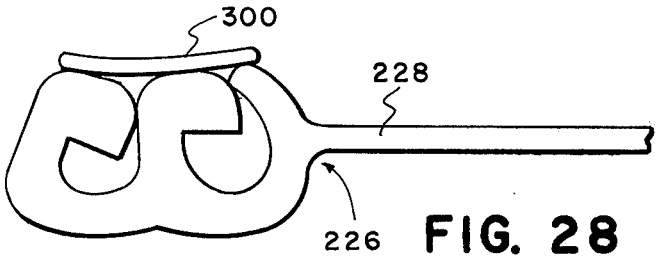

In FIG. 28 a relatively simple and inexpensive dust cap which can be used with both the fastener 26 of FIG. 3 and fastener 226 of FIG. 18 is illustrated as a tape 300 which can be placed in elongated strip form along the top edge of the body portion of the fastener to prevent dirt or dust from entering the openings into the grooves of the fastener. However, of course, this form of dust cap does not seal the ends of the fastener and dirt or moisture can accumulate from the ends, although the ends could be plugged to prevent this if the entry of moisture or dirt from the ends of fastener is a problem.

Figure 29:
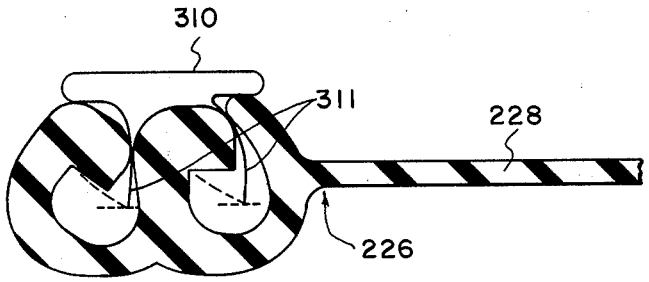

A similar type of dust cap is also illustrated in FIG. 29 as a pre-shaped metallic or plastic strip member 310 which includes two downwardly projecting members 311 which fit into the grooves of the fastener. Dust cap 310 performs in the same manner as that illustrated in FIG. 28, however, it is less easily dislodged from the fastener and, of course, can be readily used. Since the fasteners of this invention are generally used during the manufacture of construction panels of uniform lengths, the reuse of the dust caps described is feasible if they are returned from the field.

Figure 30:
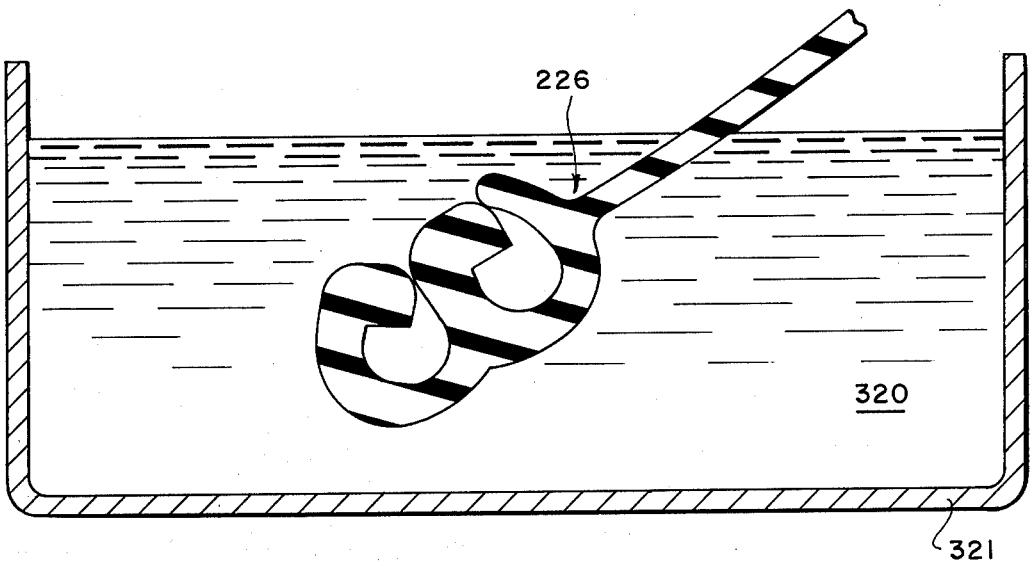
Figure 31:
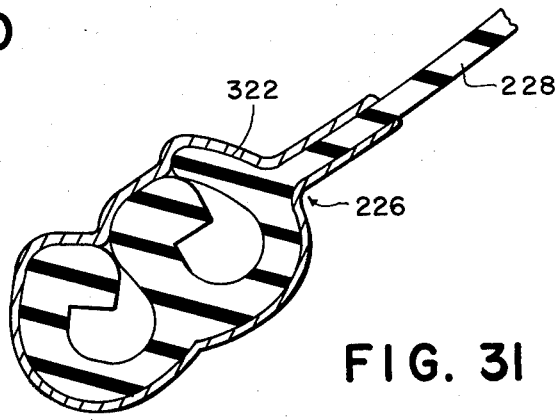

FIGS. 30 and 31 illustrate the coating of the fasteners of this invention with a strippable protective coating such as "Spraylat" or polyurethane strippable coating #TR-4641. For this purpose a quantity of a strippable coating material 320 is placed in a container 321 which is generally an elongated trough of sufficient length to permit a strip of fastener material of usable length to be dipped in the trough coated with strippable coating material. In this manner a protective coating 322 is provided about the fastener and this coating can be peeled and stripped away in the field as required to permit installation of the fasteners. In addition it might be desirable to incorporate a transferring lubricant in the strippable film similar to that included on the other dust cap materials described so that when the film is stripped from the fastener, a residue of lubricant is left on the fastener. It may also be desirable to force the fastener cavity open during the dipping process so that the strippable film material will flow into the fastener cavities and set-up prior to the time the residual force brings the teeth together. This would, to a limited degree, open the teeth and make the fastener easier to close after peeling the strippable film from the teeth. It would also distribute the lubricant over the cavity area where it is required.

Figure 32:
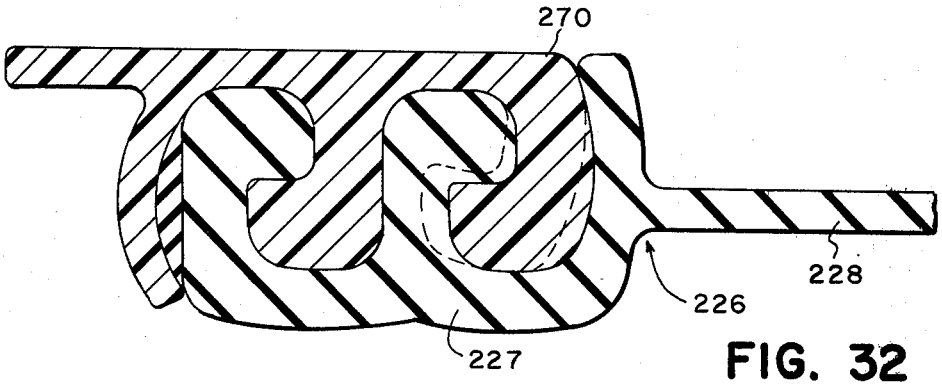
FIG. 32 illustrates the use of the dust cap of FIG. 25 with the fastener shown in FIG. 18.
Figure 33:
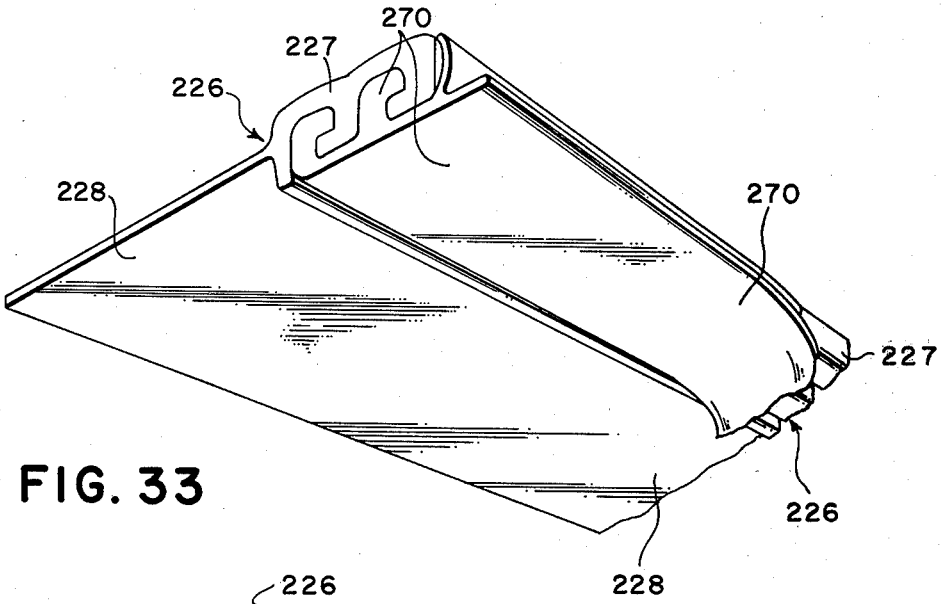
FIG. 33 illustrates the step of removing the dust cap from the fastener of FIG. 32 just prior to coupling with a similar fastener.
Figure 35:
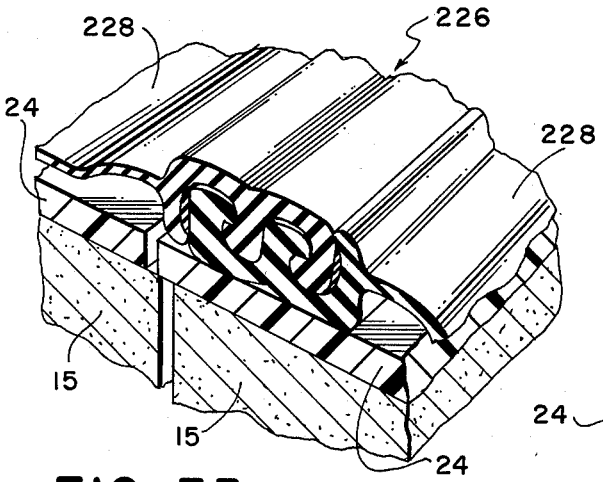
FIG. 35 is an end view in elevation identical to FIG. 33 taken after the fasteners have creeped back to their pre-shaped pinched-in positions of FIG. 18.
Figure 34:
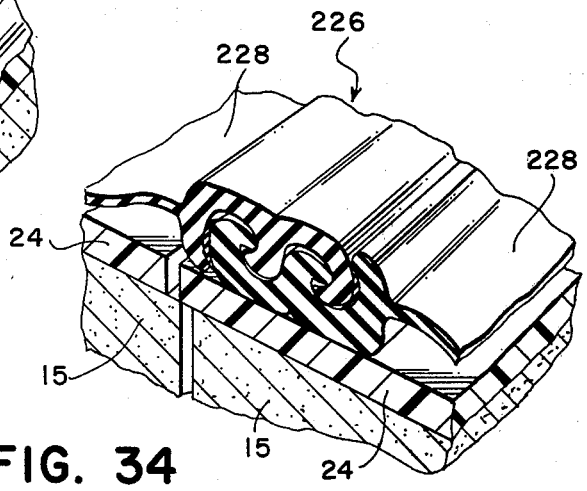
FIG. 34 is an end view in elevation illustrating the relationship of the coupled fasteners shortly after being coupled together.

As previously noted the forms of dust caps described are but a few of the different types of devices which may be used to protect the fasteners of this invention from the accumulation of dirt and moisture from the time it is manufactured until the time it is actually installed in the field. Also, as noted the preferred form of dust cap described with respect to FIG. 25 can be effectively used with the FIG. 18 embodiment of the fastener to cause the pinched-in elements of fastener 226 to be spread open prior to field installation as shown in FIG. 32. Because of the permanent set of the fastener caused by the irradiation process, even though the fastener is spread open by the insertion of dust cap 270, the fastener will return to its pre-shaped configuration as illustrated in FIG. 18 when the dust cap is removed. However it has been found that this does not occur immediately upon removal of the dust cap so that during field installation, (as illustrated in FIGS. 34 and 35) installation of two fasteners together is facilitated by use of a dust cap in the form of dust cap 270. Thus, as illustrated by FIG. 33, in the field just prior to connection of two fasteners together dust cap 270 is removed from fasteners 226, and the fasteners connected together as illustrated in FIG. 34 while the locking elements of the respective fasteners are still spread open because of the use of dust cap 270. Also, the lubricant previously applied to the dust cap will have been transferred to the fastener. In a few hours after connection of the fasteners together as shown in FIG. 34, they will return to their pre-shaped configuration as shown in FIG. 35 to effectively increase the pressure throughout the length of the fasteners in the areas of intense contact as previously described. Because of the fact that the fastener does not return immediately to its pre-shaped configuration after removal of the dust cap the installation process if factilitated and a relatively faster installation is provided than would be possible if the fasteners elements were installed in their pre-shaped configuration.

It is important to understand that there are two conflicting features inherent in the pinched-in fastener. In the pinched-in fastener, if it is fully irradiated until it becomes very elastic such as rubber, it grips very satisfactorily, however, this also results in the fastener being more difficult to force together. Thus, it is necessary to reach a satisfactory compromise between these two conflicting characteristics. In the case of use of the dust cap 270 as illustrated in FIG. 32, the fastener is held apart and if it does not contract or "snap back" too rapidly, it can be easily joined to another fastener.

Also, during the installation of adjacent the panels in the field and the coupling together of their fasteners, a roller (not shown) can be used to apply uniform pressure along the seam provided by the fasteners during installation to insure that the coupling of the fasteners is complete and further speed up the installation process. If desired, a member (not shown) may be used to form a backing against which the fasteners can be pressed by the roller as it moves down the seam. However, where the fasteners are arranged so that the bottom fastener (i.e. the upward facing fastener along edge 20 in FIG. 2) rest on one of the underlying panels, and the top fastener (which extends over the edge of the other panel), the upward facing fastener has a firm backing and is easily joined to the over-lying fastener by apply pressure.

As should be evident from the above description of the various embodiments and features of this invention, the fasteners described, and the process described for manufacturing and utilizing them may take a number of different forms. For example, while the color stripe is conveniently co-extruded with the fastener material as described, since it generally serves no further function once the fasteners have been installed in the field, the color stripe could be painted on the outside surface of the fasteners. Also, it may be desirable to add a component to the fastener compound (or to coat the fastener) to effectively render it fireproof, particularly where it is used with roof panels. Further, the dust caps described can be installed as a part of the extrusion process to eliminate the number of steps and handling required to manufacture the fastener.

Also, the lubricant for the fastener can be provided by a solvent, such as toluene, added to the surface of the fastener just prior to installation. Since the solvent will eventually cause chemical bonding of the fasteners together, it is preferred that if the solvent is added that the fastener be extruded in its pinched-in configuration of FIG. 18, but that it not be irradiated. After manufacture it can be protected by a dust cap such as illustrated in FIG. 28, and the solvent then applied in the field when the dust cap is removed to function as a lubricant for correction to a similar fastener.

From the foregoing, it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

While many possible embodiments may be made of the invention without departing from the scope thereof, it is to be understood that all matter herein set forth or shown in the accompanying drawings is to be interpreted as illustrative and not in a limiting sense.

What is claimed is:

1. A fastener adapted to interlock with another similar fastener to provide a seal between the fastener, said fastener including a body portion including a plurality of male and female members for interlocking engagement with similar such members of said similar fastener, said fastener being made by a process including the steps of:

mixing and combining a fastener material including Hypalon, and manufacturing the fastener from said material; and utilizing a dust cap prior to connection of said fastener to said similar such fastener to transfer a lubricant to said fastener while protecting the fasteners from an accumulation of dirt.

2. The fastener of claim 1 further including indicator means located on said body for providing a distinctive indication when said coupling means is not at least substantially fully engaged with the adjacent fastener.

3. The fastener of claim 1 wherein said fastener body is of a configuration with respect to said similar such fastener to provide at least one line of intensive contact to provide sealing between the fasteners.

4. The fastener of claim 1 where said the male and female members of said fastener body are proportioned with respect to the male and female members of said similar such fastener so that at least one cavity is provided for the collection of dirt between the walls of the mated portions of said fastener bodies when mated together.

5. The fastener of claim 1 further including a web portion.

6. The fastener of claim 1 wherein said body portion of said fastener is made of a cross-linked hypalon filled material.

7. The fastener of claim 6 wherein said cross-linked material is provided by irradiating said body with Beta rays.

8. The fastener of claim 1 where said dust cap is extruded with a lubricant added thereto in the extrusion process and wherein the added lubricant is transferred from said dust cap to said fastener.

9. The fastener of claim 8 wherein said added lubricant is slip.

10. A process of making a pre-shaped fastener adapted to be disposed along an edge of a panel in a construction system including a plurality of such panels arranged end to end, and adapted to interlock with a fastener disposed along the adjacent edge of an adjacent panel in the construction system to provide a seal between the adjoining panels, said fastener including a body portion including a plurality of male members with grooves between them for interlocking engagement with similar such members of said another fastener, and a web portion, said process including the steps of:

combining and mixing the fastener material;

extruding a length of fastener from said material including said body portion and web portion;

cross-linking substantially only said body portion to cause substantial stiffening and permanent settling of said body portion; and, spooling a length of fastener together into a spool prior to cross-linking, and wherein said cross-linking step includes aligning said spool under a source of irradiation with said body portion of said fastener being adjacent said source of irradiation, and irradiating substantially the entire top surface of said spool only substantially to the depth of said body portion.

11. The process of claim 10 wherein said fastener is bonded by said web portion along an edge of a construction panel and further including the steps of cutting a length of said fastener to substantially the length of said edge and utilizing heat and pressure to bond said web portion of said fastener to said panel.

12. The process of claim 11 further including the step of installing a dust cap about the male and female member of said fastener upon completion of manufacture.

13. The process of claim 12 including the step of mixing a lubricant with said fastener material prior to extrusion to aid in extrusion of the fastener and to function as a lubricant for the manufactured fastener during field installation.

14. The process of claim 13 further including the step of co-extruding a color stripe material with said fastener to provide a distinctive indication when said fastener is not at least substantially fully engaged with said another fastener.

15. The process of coupling together two pre-shaped fasteners each having a plurality of male locking members having a substantially permanent set in a configuration wherein at least two of the male members are pinched-in towards each other so that they have to be spread apart to permit coupling of the fasteners, comprising the steps of:

installing a dust cap member in the locking elements of each fastener subsequent to manufacture and prior to shipment to the field for utilization to cause the male locking members to spread apart from their normal pinched-in configuration, removing said dust caps in the field prior to coupling of said fasteners, and coupling said fasteners together before the male members thereof return to their pinched-in, permanently set configuration.

16. The process of claim 15 wherein said dust cap member includes a body portion including male members projecting into the space between said male locking members, and a handle portion.

17. The process of claim 16 wherein said male members of the dust cap substantially completely fill the space between said male locking members.

18. A process of making a pre-shaped fastener adapted to be disposed along an edge of a panel in a construction system including a plurality of such panels arranged end to end, and adapted to interlock with a fastener disposed along the adjacent edge of an adjacent panel in the construction system to provide a seal between the adjoining panels, said fastener including a body portion including a plurality of male members with grooves between them for interlocking engagement with similar such members of said another fastener, and a web portion, said process including the steps of:

combining and mixing the fastener material;

extruding a length of fastener from said material including said body portion and web portion;

cross-linking substantially only said body portion to cause substantial stiffening and permanent setting of said body portion;

installing a dust cap about the male and female member of said fastener upon completion of manufacture; and utilizing said dust cap to transfer a lubricant to said fastener.

19. The process of claim 13 wherein said lubricant is slip added to the dust cap during manufacture thereof.

* * * * *